United States Patent [19]

Moraw et al.

[11] 4,105,323

[45] Aug. 8, 1978

[54] PROCESS AND APPARATUS FOR RECORDING DEFORMATION IMAGES

[75] Inventors: Roland Moraw; Günther Schädlich, both of Naurod, Fed. Rep. of Germany

[73] Assignee: Hoechst Aktiengesellschaft, Frankfurt am Main, Fed. Rep. of Germany

[21] Appl. No.: 666,406

[22] Filed: Mar. 12, 1976

[30] Foreign Application Priority Data

Mar. 13, 1976 [DE] Fed. Rep. of Germany ..... 2510910

[51] Int. Cl.[2] ..... G03G 15/00

[52] U.S. Cl. ..... 355/9; 96/1.1; 358/129; 346/151; 365/126

[58] Field of Search ..... 352/224, 92; 355/9; 96/1.1; 340/173 TP; 178/6.6 TP; 346/151

[56] References Cited

U.S. PATENT DOCUMENTS

| | | | |
|---|---|---|---|
| 3,076,393 | 2/1963 | Campbell | 354/5 |
| 3,167,747 | 1/1965 | Hughes | 346/151 |
| 3,196,008 | 7/1965 | Mihajlov | 178/6.6 TP |
| 3,248,029 | 4/1966 | Money | 352/166 |
| 3,291,601 | 12/1966 | Gaynor | 96/1.1 |
| 3,359,469 | 12/1967 | Levy | 317/262 |
| 3,360,784 | 12/1967 | Gaynor | 340/173 TP |
| 3,437,336 | 4/1969 | Enke | 271/45 |
| 3,503,678 | 3/1970 | Ludwig | 352/224 |
| 3,507,569 | 4/1970 | Goto | 352/129 |
| 3,692,404 | 9/1972 | Lester | 355/9 |
| 3,701,596 | 10/1972 | Hill | 352/129 |
| 3,730,621 | 5/1973 | Sullivan | 96/1.1 |
| 3,765,757 | 10/1973 | Weigl | 355/3 |

FOREIGN PATENT DOCUMENTS

| | | |
|---|---|---|
| 2,557,795 | 8/1976 | Fed. Rep. of Germany. |
| 1,075,075 | 7/1967 | United Kingdom. |

*Primary Examiner*—Monroe H. Hayes
*Attorney, Agent, or Firm*—Richard L. Schwaab

[57] ABSTRACT

A method and apparatus are disclosed for recording information by deformation on a recording material having a photoconductive thermoplastic layer supported by a flexible transparent backing layer, characterized by the provision of electrostatic attraction means for stabilizing the recording material against lateral displacement during the continuous transport of the recording material through an exposure station. To this end, there are provided corona means for electrostatically charging the recording material prior to the transport thereof through the exposure station, and a stationary conductive layer of a given potential is arranged beneath the recording material opposite the charging and exposure stations, whereby the charged recording material is attracted to the conductive layer. A further conductive layer of given potential may be provided for stabilizing the charged recording medium during transport through a read-out station. Laterally flanged guide roller means are also provided for laterally stabilizing the recording material during transport between the supply and take-up reels.

11 Claims, 5 Drawing Figures

PROCESS AND APPARATUS FOR RECORDING DEFORMATION IMAGES

BRIEF DESCRIPTION OF THE PRIOR ART

It is known in the patented prior art to provide apparatus for recording by electrostatic charging deformation images on a recording material composed of a photoconductive thermoplastic recording layer arranged on a flexible and transparent support layer. The recording material is usually in the form of a roll of film that is continuously transported from a supply roller to a winding roller during the exposure of the recording material to information material and the subsequent thermal development of the information.

Photoconductive thermoplastic layers are characterized by their short access time after exposure and by the dry, thermal and chemical-free development. The layers are electrostatically charged, exposed and then developed by means of a thermal shock. The copied information is stored in the form of a deformation pattern that can be erased by reheating.

The recording has previously been carried out, in most cases, with the recording material being in a spacially fixed position relative to the charging, exposure and development stations or with the recording material making a discontinuous movement relative to the recording stations. In this method, individual images are recorded, and not series of images.

The photoconductive and thermoplastic recording materials are particularly suitable for the recording of phase holograms.

One field of application of holography is the optical storage of data. For this purpose a method has been proposed (for example, in the German Offenlegungsschrift No. 2,203,246) in which a series of individual holograms, which may overlap, is recorded on the continuously moving recording material by means of laser flashes. This recording method is called sequential data storage. The sequential holographic data storage using photoconductive and thermoplastic recording materials, which are extremely suitable on account of their short access time, is only possible if the recording is carried out continuously, and not fixed or discontinuously.

In connection with this recording technique it has previously been suggested to guide the moving recording material in such a manner that it is self-supporting in the recording area, either by means of a drum having a groove or by means of a film guiding plate having a groove. However, the contact between the film and the film-guiding element is obtained only by the mechanical tension of the film, as, for example, by winding it around the drum or guiding the film at a small angle relative to the guiding plate. This solution of the problem leads to acceptable results, if the film moves at a uniform speed. If the film speed changes, especially when the movement is started or interrupted, a relatively slowly subsiding swinging of the film occurs, a fact which may lead to the film being detached from the guiding element. This may cause lateral displacement of the film with the result that the recording is an uneven track that makes it difficult to read the stored information.

SUMMARY OF THE INVENTION

The present invention was developed to avoid the above and other drawbacks of the known deformation recording apparatus, and to provide a recording apparatus which prevents detachment, or displacement of the continuously transported recording material even in the event of appreciable changes in transport speed.

In accordance with a primary object of the invention, improved deformation image recording apparatus is provided in which lateral displacement of the recording material is prevented by moving the recording material in sliding contact over at least one first guide means which electrostatically attracts the recording material, because of an electrostatic charging effect applied thereto by corona means, and by preventing lateral displacement of the recording material by means of record guide means including at least one guide roller having at least one continuous lateral support edge.

In accordance with a more specific object, the thermal development of the recording material for the fixing of the deformation images is preferably controlled by means of a control signal arranged on the recording material.

According to a more specific object of the invention, adjustable first guide means are provided opposite a charging station and an exposure station, and the recording material is moved in close contact over the surface of said first guide means during transport from a supply roll to a winding roll, said first guide mean- having a conductive layer which is connected to a given potential, the recording material being transported via second guide means including guide rollers each having a lower lateral supporting edge and upper cover plate.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
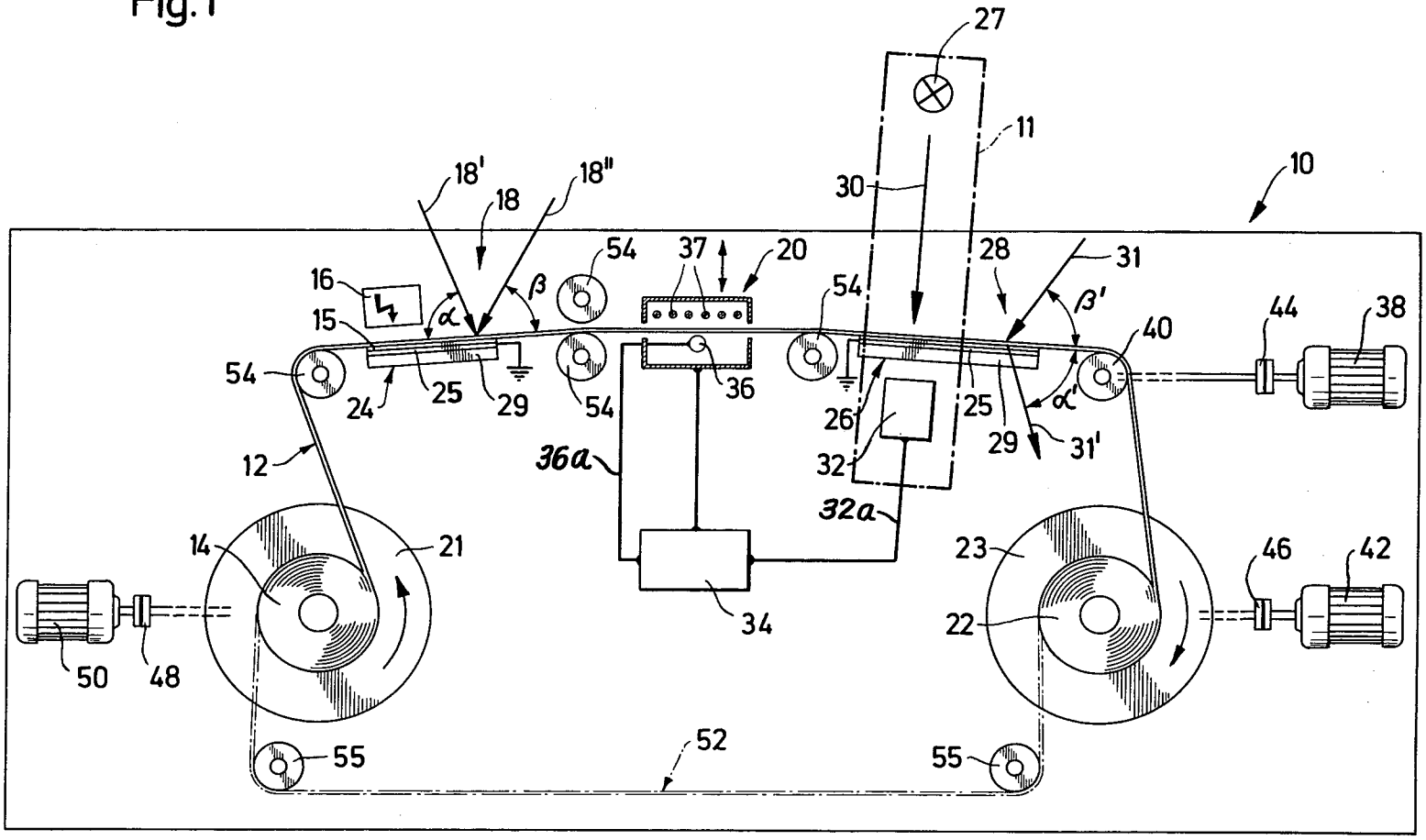
FIG. 1 is a schematic view of the image deformation recording apparatus of the present invention.

Referring first more particularly to FIG. 1, the image deformation recording apparatus 10 of the present invention includes a supply reel 14 from which the photoconductive and thermoplastic recording material 12 is unwound and guided, via a charging station 16, an exposure station 18 and a development station 20, to a winding take-up reel 22.

Figure 3:
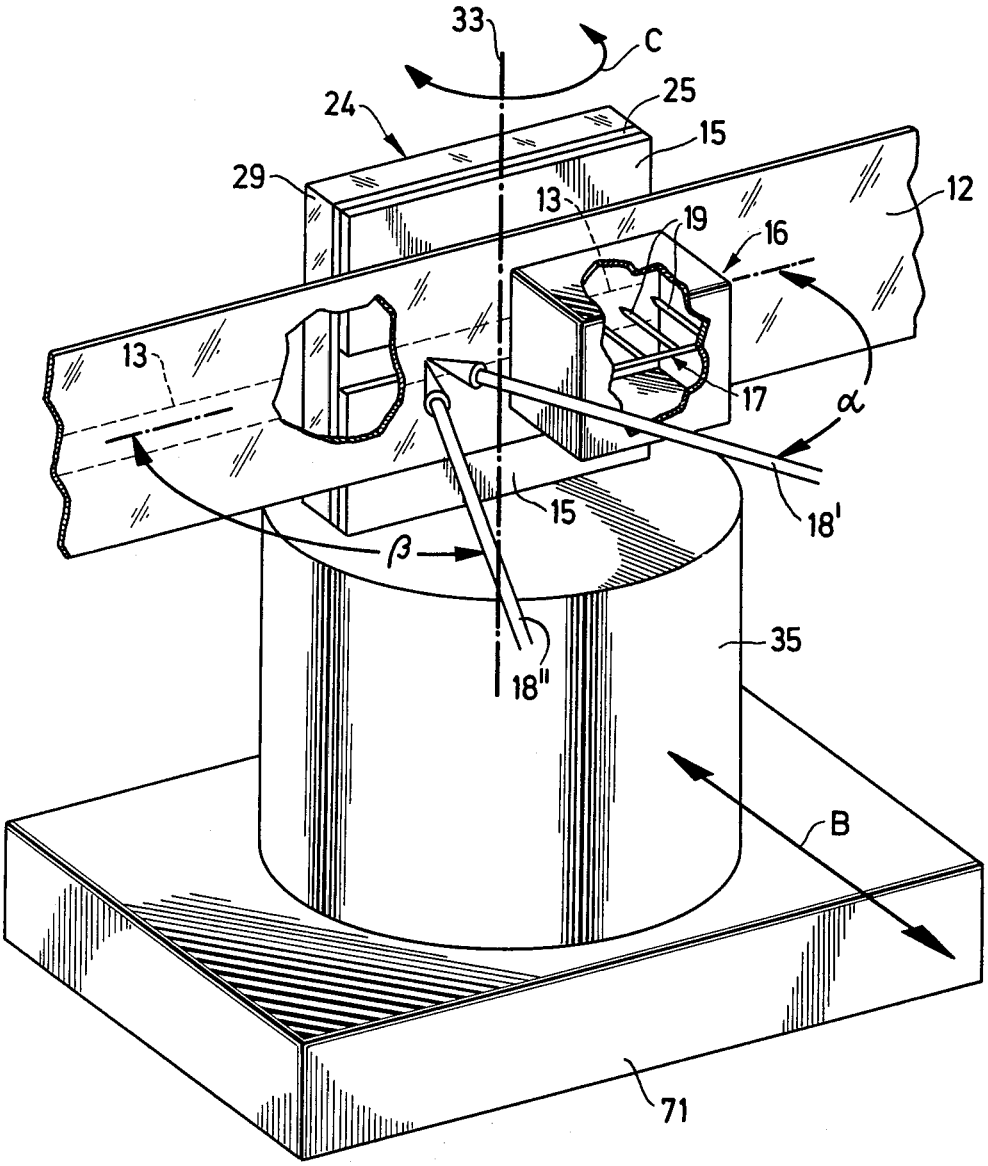
FIG. 3 is a detailed perspective view of additional guide means of FIG. 1 for retaining the recording material in place.

First guide means 24 are in sliding contact with the recording material 12 by means of electrostatic attraction, said guide means extending along the charging and exposure stations 16 and 18 (but the length of the guide means not being limited thereby). In order to obtain the desired electrostatic attraction, the guide means 24 includes a conductive layer 25, which is connected to a given potential, for example, a ground potential. The electrostatic attraction is obtained by electrostatically charging the recording material 12. The conductive layer 25 of the guide means 24 is arranged on a transparent plate 29 formed, for example, of glass. On the conductive layer 25 spacers 15 are preferably arranged on both sides of a recording track 13 (as shown in FIG. 3), which spacers 15 guarantee that the recording material 12 is kept at a certain distance from the conductive layer 25 in the area of the recording track and that an air gap exists that renders possible the recording of information, which is irradiated by light, on the recording track 13. There may be several recording tracks arranged beside each other, although this is not shown in the drawing.

In order to obtain the desired electrostatic attraction, the recording material 12 includes a photoconductive and thermoplastic layer mounted directly upon a support layer, such as a polyester layer, without the provision of a conductive intermediate layer, since such a conductive layer would screen the electric field caused by the charges applied. It would be possible, of course, but quite difficult, to obtain the desired electrostatic attraction by the use of a conductive intermediate layer having a potential different from that of the guide means. The use of a transparent plate 29 in the guide means 24 renders it possible to repass and read the information recorded. The reading is performed by means of a laser beam 31 at a read-out station 28 of the device 10 by guiding the recording material 12 over further stationary guide means 26. In the alternative, the reading could be performed adjacent the exposure station 18. It is obvious that in order to permit reading at station 28 the conductive layer 25, too, must be transparent, the recording material 12 sliding over the guide means 24, 26 with its recording layer facing away from the guide means. Preferably, recording materials having a width of 35 mm are used, but the invention is not limited to a certain width of the material.

The attraction of charged films to conductive supports by electrostatic forces is strong. This attraction has been used previously for applying flexible films to a stationary platform in order to record information on the stationary film. For the removal of the adhering film in order to exchange it, special separating devices have been proposed. In the case of a high charge of the film over its entire area the force necessary for surmounting the static friction in a practicable apparatus has to be rather strong. Therefore the height of the charge must be reducible so that the recording material can be moved in a sliding contact over the guide means 24, 26 by motors having a power of up to 50 watts. The contact between the moving recording material and the guide means 24, 26 is generally sufficient to produce substantially stationary Newton's rings, which remain virtually unchanged even when the recording material stands still or starts moving.

In the case of a reduced electrostatic charge of the recording material 12, the image deformations are distinctly smaller and the forces of attraction are weaker. Preferably only the recording area, which is narrow compared with the width of the recording material, is charged up to the height of charge necessary for the recording in order to reduce the forces of attraction, whereas the remaining area of the recording material is charged only to such an extent as is necessary for producing the attraction. It is even possible, if the geometrical relations between the recording material and the guide plate are suitable, to charge the recording area to a certain height, since the scattered charges on both sides of the charge area alone cause a sufficient electrostatic attraction. For this purpose, the corona means 17 (FIG. 3) of the charging station 16 is arranged with its longitudinal side exactly opposite the recording track 13 on the recording material 12. The corona means 17 consists of several corona needles 19, which are arranged opposite the recording track 13 on the recording material 12.

For example, a suitable counter-electrode, too, may be used for limiting the relatively high charge exactly to the recording area, or corona arrangements having gratings may be used for adjusting the height of charge desired in the charging area or in the area of the recording material which is not needed for the recording.

The recording process including a relative grading of the heights of charge transverse to the width of the recording material is very satisfactory as far as sliding adhesion goes. However, if the recording material passes several times, scratchings occur that are due to electrostatically attracted dust particles. Apparatuses for cleaning the recording material by means of felt-like wipers reduce the number of scratches but do not allow an absolutely scratch-free guidance of the recording material. An improvement is achieved by the fact that the recording material is self-supporting in the recording area. A guide means for achieving this aim consists, for example, of a conductive glass plate having a groove in the recording area or of a conductive glass plate having spacers, for example composed of a photo resist or composite films having a suitable thickness as described with reference to FIG. 3. Films having good sliding properties are particularly suitable for this. Paper strips glued onto the glass plate may thus be used as spacers, too. In this case the groove is wider than the recording area. Support films of the thermoplastic film having a thickness of 100 $\mu$m allow to bridge widths of up to several millimeters. The thickness of the spacers may be chosen freely and in general depends on the capacity of self-support required of the recording material. For example, spacers having a thickness of 0.3 mm may be arranged at distances of 3 mm. Recording tracks 13 having widths between 0.1 and 3 mm may be applied to the recording material, as well as several recording areas beside each other.

It is also possible to carry out simultaneously several individual steps to improve the image quality. The electrostatic contrast of the charge image to be thermally developed may be increased by using a transparent corona, i.e. a corona that has an open back and extends beyond the area of exposure, a fact which permits simultaneous charging and exposure.

In the case of a stationary recording material the heat energy necessary for development is produced in the form of pulses by hot air, thermal radiation or resistance heating in the conductive intermediate layer of the recording material. A characteristic feature is that the recording system is cooled to room temperature prior to each heating and that the duration of heat pulses, which is in the order of tenths of seconds, is small compared with the intervals at which variations of the room temperature occur.

In the development of a continuously moved recording material it is neither possible to apply the necessary heat energy in the form of pulses nor to obtain a cooling of the recording system to room temperature before each pulse. When the heating is started a state of equilibrium must be obtained first, in contrast to the method including pulses. The amount of heat applied to the moving recording material minus the heat losses must heat the recording material in the development area to just the development temperature. The heating performance in the recording area is not constant, even if the heating up is not taken into account, but depends, for example, to a large extent on the speed of the film. The heating performance is approximately proportional to the film speed. During the recording, which may last minutes or even hours in the case of great recording lengths, changes in room temperature probably occur, for example changes caused by the permanent heating in the development area. Therefore a thermally controllable development station 20 is necessary for a practical method of recording. The extent of the adjustment is controlled permanently or at short intervals by measuring a certain property of the recording material or the recording itself.

The analysis of an information on the recording material may be used as a control signal for the feedback of the control of the thermal development. Such an easily obtainable control signal is the freezing noise. The term 'freezing' means the formation of irregular folds in the charged and thermally developed thermoplastic layer, which cause cloudiness.

The control is effected by measuring the loss in intensity of a control beam 30 in the area of the guide means 26 by means of freezing and a photoelectric detector 32, such as a phototransistor, a photodiode, a photo element, a photocell or a photomultiplier as a part of a signaler 11, which also comprises the light source 27. The signal coming from the detector 32 is supplied via conductor 32*a* to a control unit 34, which controls the thermal development apparatus 20. Instead of the freezing signal a separate control track may be applied to the recording material 12, for example by the additional radiation of object and reference laser beams 18' and 18'' in the area of the first guide means 24 for producing a constant interference pattern. In this case the control beam 30 is a laser beam, while the detector 32 must be so constructed as to receive the laser light diffracted at the control track. In another embodiment of the control unit 34 for example, the average intensity of the laser light deflected at the recording track 13 carrying the information may also be used for the control via an integrating switching element.

If the recording apparatus and the recording material are well coordinated it is often sufficient to adjust the control beam 30, the detector 32 and the control unit 34 manually in the best possible manner, according to the recording conditions in each case, and then to carry out only one control depending on the variations in room temperature, so that the development temperature of the recording material 12, once achieved, is constantly maintained. For this purpose a temperature sensor 36 is arranged in the vicinity of the recording material 12 in the development area, and the signal emitted by the sensor is also passed to the control unit 34 via conductor 36*a*.

The heat energy for the thermal development can be produced in the known manner by hot air, thermal radiation or resistance heating. Difficulties arise with the transportation of the heat produced to the moving recording material. For example, the guiding of the recording material over a heated roller, a method which is often used in the art, has proved relatively prone to trouble, since it is very difficult to control the roller temperature with an accuracy of ± 1° C, in the case of development temperatures between about 50° and 70° C. Moreover, relatively large rollers react to changes in the control with an undesired long delay, and the contact between the moving recording material and the roller for the heat transfer is not always equally good during the short time of contact. It is also a disadvantage that in the case of a recording material that is self-supporting in the recording area and has no conductive intermediate layer, electric discharges between the roller and the recording material may occur that superpose the information.

Therefore, a contact-free development that can be controlled in a sufficiently rapid manner is preferred. For this purpose heating elements 37 of the development station 20 are arranged at a small distance from the surface of the recording material 12, distances of at least 1 mm being desirable.

Good development results are obtained by means of a ceramic radiator having a performance of 500 watts, if it is arranged at a distance of 1 cm from the back of the recording material 12, and if the recording material 12 moves at a speed of 1 cm per second. For the desired control, the radiator is moved on a guide bar vertically relative to the movement of the recording material 12.

Figure 4A:
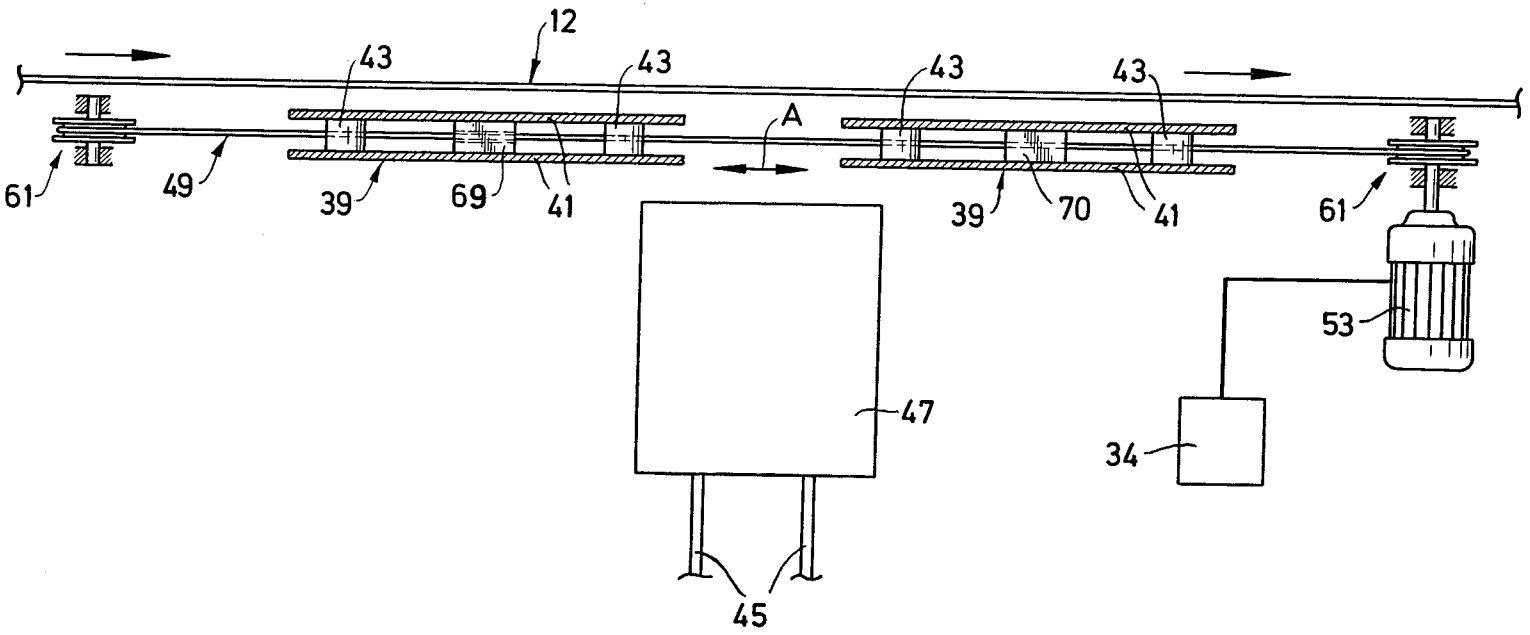
FIGS. 4*a* and 4*b* are top plan and perspective side views, respectively, of radiator and shutter means for developing the recording material.
Figure 4B:
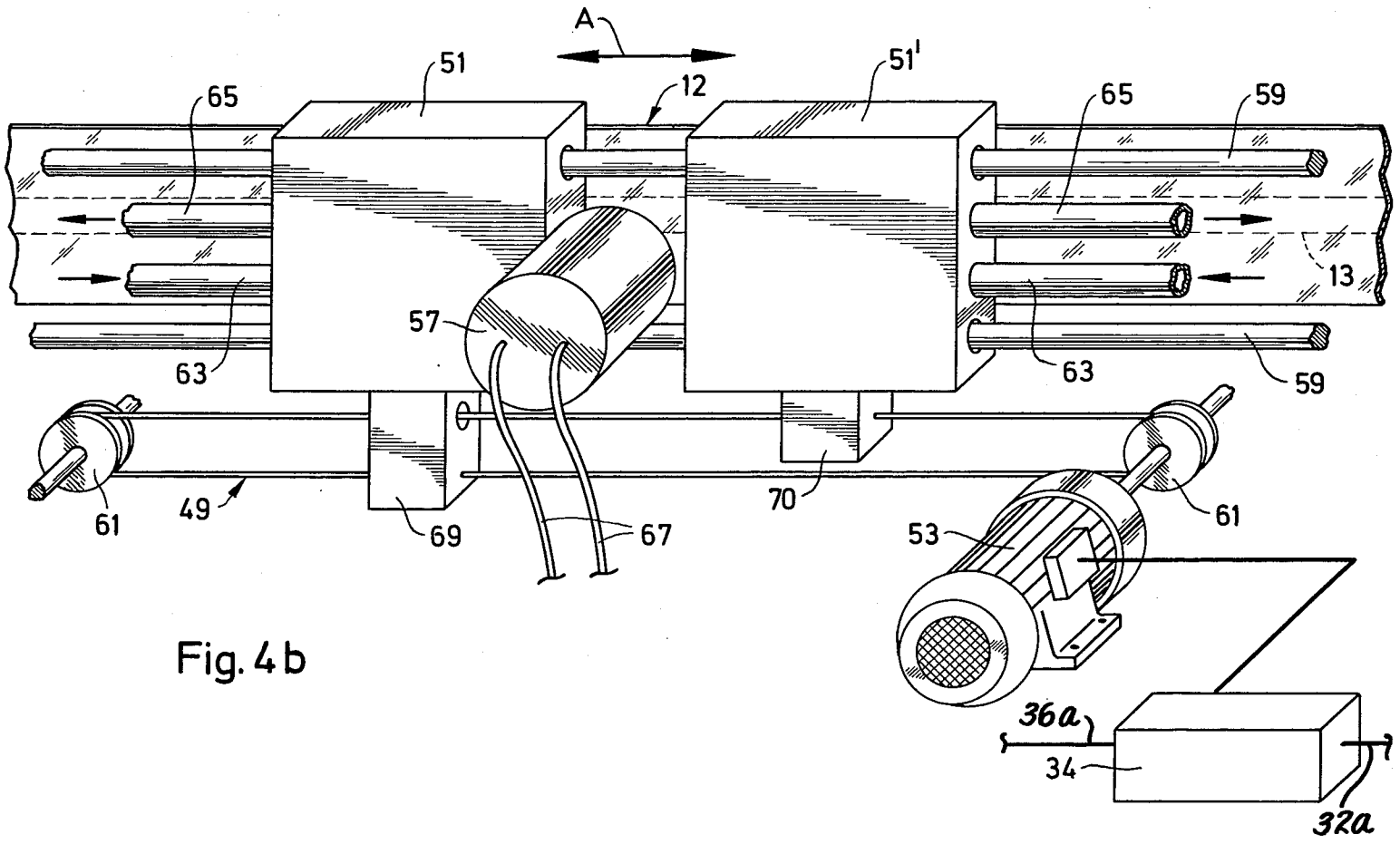

In the case of a stationary radiator 47, as shown in FIG. 4, the control is carried out thermally by insulating shutters 39. These shutters include double plates 41 that are connected via spacers 43, and the space between the plates is cooled, for example, by an air stream. This sytem has the advantage that the thermal balance in the development area is obtained within seconds, since the radiator 47 need not be switched on and off, but the shutters 39 are, depending on the heat required, opened and closed by moving them symmetrically relative to the radiator 47 in the directions indicated by the double arrow A, by means of endless drive means 49 as described in the system of shutters according to FIG. 4*b*. The radiator 47 is supplied with a voltage via electric connections 45.

In the embodiment of the system of shutters shown in FIG. 4*b* two shutters 51, 51' are movable along guide bars 59 parallel to the recording material 12 in order to screen it, to the extent required, against the heat emission of a radiator 57. The radiator 57 is supplied with a voltage via current supply conductors 67. Each of the shutters 51, 51' is hollow and includes supply and return conduits 63 and 65, respectively, for a cooling medium such as water or air. Endless drive means 49 including a pair of pulleys 61 for guiding endless member (such as a chain or rope) are provided in order to guarantee the symmetrical movement of the shutters 51, 51', one of the two pulleys 61 being driven by a fourth motor 53. This motor 53 is controlled by the control unit 34 and its direction of rotation can be reversed. The upper run of the endless member is attached to a lower extension 70 of the second shutter 51' and the lower run of the endless member is attached to a lower extension 69 of the first shutter 51, through which the upper run of the endless member moves freely.

A good heat control can also be obtained by means of a hot air stream produced by an electric hot-air generator, by controlling the heating by means of the detector 32 and/or the temperature sensor 36. A specific advantage of this embodiment of the development station 20 is the small thermal load applied to the entire system. The short heating-up period of 1 to 2 seconds makes it possible to switch the heating off during recording breaks.

The recording material 12 is moved at a constant speed during the recording. A first motor 38 is synchronized with the peripheral speed of a tension roller 40 for the recording material 12 and operates this roller 40 via a first coupling 44, which is preferably a slip clutch. The transport of the recording material 12 during the recording and reading is carried out under a great tensile stress, since the static friction in the area of the guide means 24 and 26 must be overcome. For this reason a possible drive of the supply roller 14 is ruled out, because thus the recording material would be wound up very tightly, a fact which could lead to damage of the deformation images in the wound-up roll. Therefore the system includes separate drives for the different transport movements of the recording material 12, which movements are synchronized with the wind up of the material on reel 22. For this purpose a second motor 42 is provided that operates the wind up reel 22 via a second coupling 46, for example also a slip clutch. However, the second coupling 46 may also be driven by the first motor 38. In order to repass the recording material 12, for example for reading the information recorded, it is wound back. For this purpose the first coupling 44 is disengaged and a third coupling 48 for a third motor 50 for winding back the recording material 12 on supply reel 14 is actuated. Simultaneously the static friction at the guide means 24 and 26 is considerably decreased by connecting them with a potential having the same polarity as that of the corona 17. In front of the supply reel 14 a second tension roller 54 for the recording material 12 is provided which rotates in a direction opposite to that of the supply reel 14. The reel 14 is arranged on a first supporting disc 21, and the take-up reel 22 is arranged on a second supporting disc 23.

When repassing the recording material 12 it may be desirable to increase the attraction by renewing the electrostatic charge. The recording material 12 winds round the friction roller 40 at an angle of at least 120°, the transmission being effected by the strong static friction or by the pins engaging the perforations in the recording material 12, as it is known from the usual film transport technique.

In order to protect the surface image as far as possible against outside influences during the winding of the recording material, an additional measure for the winding under a low tensile stress has proved helpful, i.e. winding up the recording material together with a protective intermediate layer 52 formed, for example, from paper. In a preferred embodiment the intermediate layer 52 is wound, for example, from the supply reel 14, via transport rollers 55, upon the winding reel 22, or vice versa.

The measures described above may be successfully applied within a speed range of the recording material 12 of between 1 cm and 10 cm per second. For higher speeds it is necessary to improve the starting technique in a manner known in the art. The first coupling 44 for the starting area, in which the recording material accelerates from standstill to the final speed desired, is a slip clutch. Furthermore the recording material 12 is guided over several rollers 54, which are flexibly suspended and are thus able to balance an extreme tensile stress at the start. The second and third couplings 46 and 48 are preferably slip clutches, too. In order to balance extreme tensile stresses it may be sufficient to have only one or some of the guide rollers 54 resiliently suspended.

The practical recording width is between 0.1 mm and several millimeters. In any case the recording material 12 must be guided accurately at the same level in order to get the recording track 13, when the material is passed, exactly to the level of the laser beam 31 of FIG. 1, which reads the information recorded. At the recording track 13 this laser beam 31 is diffracted into the beam 31', which carries the reconstructed information of the recording track 13. This information was applied in the exposure station 18 by means of an object beam 18', which interferes with a reference beam 18''. For reasons of better comprehension of the recording and reconstruction of information the corresponding beams 18', 31' and 18'', 31 in FIG. 1 at the exposure station 18 and in the reading station 28 are shown to form the same angles $\alpha,\alpha'$ and $\beta,\beta'$ with the recording material 12. In the case of a recording material having perforations an accurate guidance can be achieved by conical pins on some or all of the guide rollers 54. Recording materials without perforations are guided along the lateral edges in order to prevent lateral displacement. The lateral edges are preferably guiding elements and are arranged adjacent to a part of the apparatus.

Figure 2:
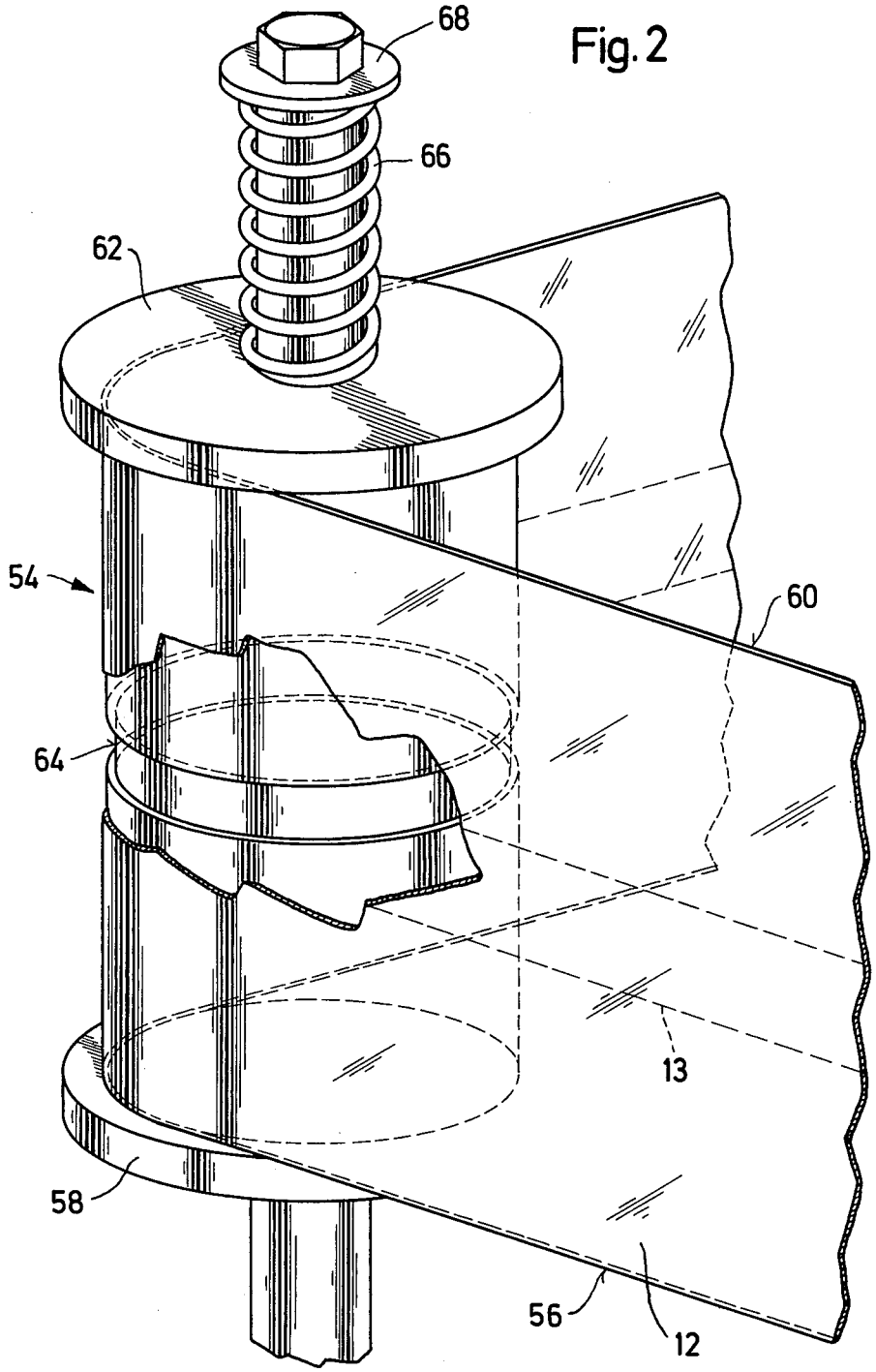
FIG. 2 is a detailed perspective view of the guide roller means of FIG. 1.

The lower lateral edge 56 of the recording material 12 rests, for example, on a projecting edge 58 of the guide roller 54 (see FIG. 2). A spring 66 exerts a pressure on a cover plate 62, which in turn presses on the upper lateral edge 60 of the recording material 12, thus maintaining a permanent contact between the recording material 12 and the edge 58. One end of the spring 66 presses against a stop plate 68 and the other end presses against the cover plate 62.

In the recording area the guide roller 54 is provided with a continuous circumferential groove 64.

The accuracy of measurement in the production of recording materials is about ± 0.03 mm. Since this figure represents the maximum variations over greater lengths of the recording material 12, the recording tracks 13, too, follow such a variation in the case of the lateral guidance described above, but can be reproduced in such a manner that when the material 12 is rewound the reading laser beam 31 hits the recording track 13 with an accuracy that is distinctly better than ± 0.03 mm.

It is particularly advantageous if one or both of the guide means 24, 26 is adjustable. This can be achieved by mounting each of the guide means 24, 26 upon a first support 35 (FIG. 3), which support is pivotable around a vertical axis 33, through the circular arc C. The first support 35 is arranged on a second support 71 which is displaceable in the directions indicated by the double arrow B, i.e. in the direction normal to the surface of the recording material 12.

The deformation images recorded on photoconductive and thermoplastic recording materials can be reused after heating them longer and more intensively than in the thermal development, thus leveling the surface deformations. By increasing the thermal energy applied to the recording material 12 the apparatus described above can thus also be used for the erasure of recording tracks 13.

While in accordance with the provisions of the Patent Statutes the preferred form and embodiment of the invention has been illustrated and described, it will be apparent that changes and modifications may be made without deviating from the inventive concepts set forth above.

What is claimed is:

1. Apparatus for recording images by deformation on the surface of a recording material including a flexible transparent support layer, and a photoconductive thermoplastic recording layer, comprising (a) charging means for electrostatically charging the recording material;

(b) exposure means for applying an image to the recording medium;

(c) transport means for continuously transporting the recording material from a supply reel to a take-up reel via, in succession, said charging means and said exposure means;

(d) first guide means for stabilizing the recording material during the transport thereof through said exposure means, said first guide means including a stationary conductive layer having a given potential and arranged opposite said charging and exposure means, whereby the electrostatically charged recording medium is drawn by attraction toward said conductive layer;

(e) second guide means for stabilizing the recording material against lateral displacement during the transport thereof between said supply and take-up reels, said second guide means including guide roller means over which the recording material is transported, at least one of the guide roller means including a pair of spaced continuous lateral flanges between which the recording material is transported;

(f) stationary third guide means for stabilizing the recording material during the transport thereof between said second guide means and said take-up reel, said third guide means including a conductive layer having a given potential, whereby the electrostatically charged recording material is attracted to the conductive layer of said third guide means during continuous transport of the recording material thereby; and (g) means supporting each of said first and third guide means for adjustment relative to the recording material, said support means including first support means for pivoting one of said first and third guide means about an axis parallel with the recording material and normal to the direction of transport of said recording material, and second support means supporting said first support means for transport in a direction normal to the recording material.

2. Apparatus as defined in claim 1, and further including (h) thermal development means arranged between said exposure means and said take-up reel for developing the image formed on the recording material by the exposure means; and (i) means for regulating the development temperature of said thermal development means as a function of a physical characteristic of the thermally developed recording material, said development temperature regulating means including opacity-responsive means responsive to the opacity of the development recording material relative to a given standard, said opacity-responsive means including a light source arranged on one side of the developed recording material, and photoelectric detection means arranged on the opposite side of said recording material from said light source, said third guide means being arranged to stabilize the recording material during the transport thereof through said opacity-responsive means.

3. Apparatus as defined in claim 2, wherein said light source is a laser.

4. Apparatus as defined in claim 2, wherein said opacityresponsive means is responsive to the area of the recording material which carries a recording track.

5. Apparatus for recording images by deformation on the surface of a recording material including a flexible transparent support layer, and a photoconductive thermoplastic recording layer, comprising (a) charging means for electrostatically charging the recording material;

(b) exposure means for applying an image to the recording medium;

(c) transport means for continuously transporting the recording material from a supply reel to a take-up reel via, in succession, said charging means and said exposure means;

(d) first guide means for stabilizing the recording material during the transport thereof through said exposure means, said first guide means including a stationary conductive layer having a given potential and arranged opposite said charging and exposure means, whereby the electrostatically charged recording medium is drawn by attraction toward said conductive layer;

(e) second guide means for stabilizing the recording material against lateral displacement during the transport thereof between said supply and take-up reels, said second guide means including guide roller means over which the recording material is transported, at least one of the guide roller means including a pair of spaced continuous lateral flanges between which the recording material is transported;

(f) thermal development means arranged between said exposure means and said take-up reel for developing the image formed on the recording material by the exposure means, said thermal development means including at least one heat generating means; and (g) shutter means arranged for displacement between said heat generating means and the recording material for controlling the amount of heat transmitted to the recording material, said shutter means including at least one hollow shutter, and inlet return conduit means for supplying a cooling fluid through the chamber of said hollow shutter.

6. Apparatus as defined in claim 5, wherein said shutter means includes a pair of shutters arranged between said heat generating means and the recording material for displacement longitudinally of the recording material, and means for simultaneously displacing said shutters in opposite senses relative to said heat generating means.

7. Apparatus as defined in claim 6, wherein said shutters are connected in opposite senses to an endless drive member, and reversible fourth motor means for driving said endless drive member to increase or decrease the heat transmitted to the recording material.

8. Apparatus for recording images by deformation on the surface of a recording material including a flexible transparent support layer, and a photoconductive thermoplastic recording layer, comprising (a) charging means for electrostatically charging the recording material;

(b) exposure means for applying an image to the recording medium;

(c) transport means for continuously transporting the recording material from a supply reel to a take-up reel via, in succession, said charging means and said exposure means;

(d) first guide means for stabilizing the recording material during the transport thereof through said exposure means, said first guide means including a stationary conductive layer having a given potential and arranged opposite said charging and exposure means, whereby the electrostatically charged recording medium is drawn by attraction toward said conductive layer;

(e) second guide means for stabilizing the recording material against lateral displacement during the transport thereof between said supply and take-up reels, said second guide means including guide roller means over which the recording material is transported, at least one of the guide roller means including a pair of spaced continuous lateral flanges between which the recording material is transported;

(f) thermal development means arranged between said exposure means and said take-up reel for developing the image formed on the recording material by the exposure means, said thermal development means including at least one heat generating means; and (g) shutter means arranged for displacement between said heat generating means and the recording material for controlling the amount of heat transmitted to the recording material, said shutter means including a pair of spaced parallel plates, and means connecting said plates to define a passage for the flow of a cooling fluid between said plates.

9. Apparatus for recording images by deformation on the surface of a recording material including a flexible transparent support layer, and a photoconductive thermoplastic recording layer, comprising (a) charging means for electrostatically charging the recording material;

(b) exposure means for applying an image to the recording medium;

(c) transport means for continuously transporting the recording material from a supply reel to a take-up reel via, in succession, said charging means and said exposure means;

(d) stationary first guide means for stabilizing the recording material during the transport thereof through said exposure means, said first guide means including a stationary conductive layer having a given potential, said conductive layer being arranged opposite both said charging means and said exposure means, whereby the electrostatically charged recording medium is drawn by attraction toward said conductive layer;

(e) second guide means for stabilizing the recording material against lateral displacement during the transport thereof between said supply and take-up reels, said second guide means including guide roller means over which the recording material is transported, at least one of the guide roller means including a pair of spaced continuous lateral flanges between which the recording material is transported;

(f) thermal development means including a hot-air heat generator arranged between said exposure means and said take-up reel for developing the image formed on the recording material by the exposure means; and (g) means for regulating the development temperature of said thermal development means as a function of a physical characteristic of the thermally developed recording material.

10. Apparatus for recording images by deformation on the surface of a recording material including a flexible transparent support layer, and a photoconductive thermoplastic recording layer, comprising (a) charging means for electrostatically charging the recording material;

(b) exposure means for applying an image to the recording medium;

(c) transport means for continuously transporting the recording material from a supply reel to a take-up reel via, in succession, said charging means and said exposure means;

(d) stationary first guide means for stabilizing the recording material during the transport thereof through said exposure means, said first guide means including a stationary conductive layer having a given potential, said conductive layer being arranged opposite both said charging means and said exposure means, whereby the electrostatically charged recording medium is drawn by attraction toward said conductive layer; and (e) second guide means for stabilizing the recording material against lateral displacement during the transport thereof between said supply and take-up reels, said second guide means including vertically arranged guide roller means over which the recording material is transported, said guide roller means having at one end a fixed continuous peripheral flange, a cover flange connected with the other end of the guide roller for axial displacement relative thereto, and spring means biasing said cover flange axially indwardly toward said fixed flange.

11. Apparatus as defined in claim 1, wherein each of said first and third guide means includes a support plate upon which the conductive layer is supported and arranged on the opposite side of said conductive layer from the recording material, said support plate being formed of a transparent non-conductive material, and a pair of parallel spaced non-conductive spacer means arranged on said conductive layer on opposite sides of the area of recording material, said spacer means being arranged to space the recording material from said conductive layer.

* * * * *

UNITED STATES PATENT OFFICE

CERTIFICATE OF CORRECTION

Patent No. 4,105,323 Dated August 8, 1978

Inventor(s) Roland MORAW, Guenther SCHAEDLICH

It is certified that error appears in the above-identified patent and that said Letters Patent are hereby corrected as shown below:

Cover Sheet, FOREIGN APPLICATION PRIORITY DATE, kindly delete "Mar. 13, 1976" and insert instead -- Mar. 13, 1975 --.

In Column 12, Claim 10, line 32, kindly delete "indwardly" and insert instead -- inwardly --.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*